US007464447B2

(12) United States Patent
Khalifa et al.

(10) Patent No.: US 7,464,447 B2
(45) Date of Patent: Dec. 16, 2008

(54) SHORTENED BUCKLE SYSTEM

(75) Inventors: Aly Khalifa, Raleigh, NC (US); Shih-Sheng Yang, Taipei (TW)

(73) Assignee: Universal Trim Supply Co., Ltd., Taipei Hsien (TW)

( * ) Notice: Subject to any disclaimer, the term of this patent is extended or adjusted under 35 U.S.C. 154(b) by 0 days.

(21) Appl. No.: 11/657,794

(22) Filed: Jan. 25, 2007

(65) Prior Publication Data

US 2007/0175008 A1 Aug. 2, 2007

Related U.S. Application Data

(60) Provisional application No. 60/763,116, filed on Jan. 27, 2006.

(51) Int. Cl.
*A44B 11/25* (2006.01)

(52) U.S. Cl. ..... 24/615; 24/625

(58) Field of Classification Search ..... 24/614, 24/615, 625, 619, 620, 613, DIG. 52, 607, 24/200, 182, 197

See application file for complete search history.

(56) References Cited

U.S. PATENT DOCUMENTS

| | | | | | |
|---|---|---|---|---|---|
| 312,679 | A * | 2/1885 | Wagner | 24/182 |
| 1,775,137 | A * | 9/1930 | Ostrower | 24/182 |
| 3,206,816 | A * | 9/1965 | Vilcins et al. | 24/200 |
| 4,281,440 | A * | 8/1981 | Britz | 24/191 |
| 4,800,629 | A * | 1/1989 | Ikeda | 24/170 |
| 5,421,059 | A * | 6/1995 | Leffers, Jr. | 16/87.4 R |
| D362,742 | S * | 10/1995 | Bergman | D2/745 |
| 5,542,161 | A * | 8/1996 | Anscher | 24/614 |
| 6,148,486 | A * | 11/2000 | Uehara et al. | 24/170 |
| D469,383 | S * | 1/2003 | Young | D11/200 |
| 6,571,434 | B2 * | 6/2003 | Ortiz | 24/615 |
| 6,665,915 | B1 * | 12/2003 | Higuchi | 24/615 |

* cited by examiner

*Primary Examiner*—Robert J Sandy
(74) *Attorney, Agent, or Firm*—Leong C. Lei

(57) ABSTRACT

A buckle assembly having a male buckle member and a female buckle member. The male buckle member contains an engaging means for engagement with the female portion and a male strap receiving means for coupling to a first strap. The female buckle member contains a receiving volume for engaging with the male buckle section and a female strap receiving means positioned on the bottom or top of the receiving volume and substantially along its open engaging end so that when the male and female buckle members are engaged and locked the female strap receiving means substantially abuts an interface section of the male buckle member causing the first and second strap to be in close proximity.

7 Claims, 18 Drawing Sheets

SHORTENED BUCKLE SYSTEM

CROSS-REFERENCE TO RELATED APPLICATIONS

This application claims the priority of provisional application Ser. No. 60/763,116 filed in the United States Patent and Trademark Office on Jan. 27, 2006

BACKGROUND OF THE INVENTION

The invention is generally directed to shortened buckle designs which provide for an ability to have a buckle which allows the straps to turn corners or in other applications where a rigid buckle assembly is not preferred. The buckles are designed to provide a shortened distance between the two straps which are connected to the male and female portions of the buckle to allow more flexibility about the buckle region.

Generally, injection molded plastic buckles are formed in various shapes and designs and are generally injection molded out of plastics into a male portion and a female portion. Generally, each of the male and female portions has an integrally formed loop or path by which a nylon strap can be secured to the male or female portion of the buckle. Generally, the closure is formed by sliding the male portion of the buckle into the female portion until the two portions lock together in a releasable fashion. Generally, a squeezing or pressing of elements on one or both of the male and female portions allows the two buckle pieces to disengage.

While there are many different types of buckles with different shapes, sizes and suitability for different applications, there is a need for buckles which do not form an unnecessarily rigid section of the closure assembly which includes the straps and buckle. Generally, each of the male and female portions of the buckle has an engaging end for engaging with the other buckle piece and a strap receiving end which includes a loop or tortuous path through which a strap is looped. Buckles of this sort are often used in backpacks, clothing, messenger bags and other containers, camping related items and a wide variety of other applications where some aspect or portion of an item needs to be cinched in place in a fashion which allows easy closing and re-opening.

However, these prior art buckle systems have tended to be formed as rigid plastic members and there is a distance between the strap engaging portions of the two pieces of the buckle when the buckle is closed is generally a very rigid portion of the closure assembly. Whereas the straps themselves, usually made of a nylon webbing or similar material are inherently flexible, the buckle is generally rigid and the buckle's rigidity tends to affect the usefulness of the closure assembly including a buckle in applications where it is useful that the buckle be able to adapt to a corner or sharply curved region. This is particularly so where there is a short strap involved. Accordingly, there is a need for an improved closure system incorporating a buckle and straps in which the flexible straps are held proximate to each other and in which the buckle does not significantly add rigidity to the system and allows the straps to turn a corner proximate the buckle assembly.

SUMMARY OF THE INVENTION

The invention is generally directed to a shortened buckle assembly including a male component with a strap engaging portion and a female buckle portion engaging section and a female buckle section including a male receiving section and a strap receiving section wherein the male female engaging section is adapted to be received within the male receiving section of the female buckle section, selectively locked into a locked position and in the locked position the strap receiving section of the male buckle section is proximate the strap receiving section of the female buckle section.

Accordingly, it is an object of the invention to provide an improved shortened buckle assembly in which the closed buckle has the strap receiving sections of the two buckled pieces in close proximity to allow the strap closure system to retain flexibility in the region of the buckle.

Another object of the invention is to provide an enhanced more compact buckle arrangement in which the rigidity imposed on the strap system is significantly reduced by shifting the strap engaging portions of the two buckle pieces next to each other.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
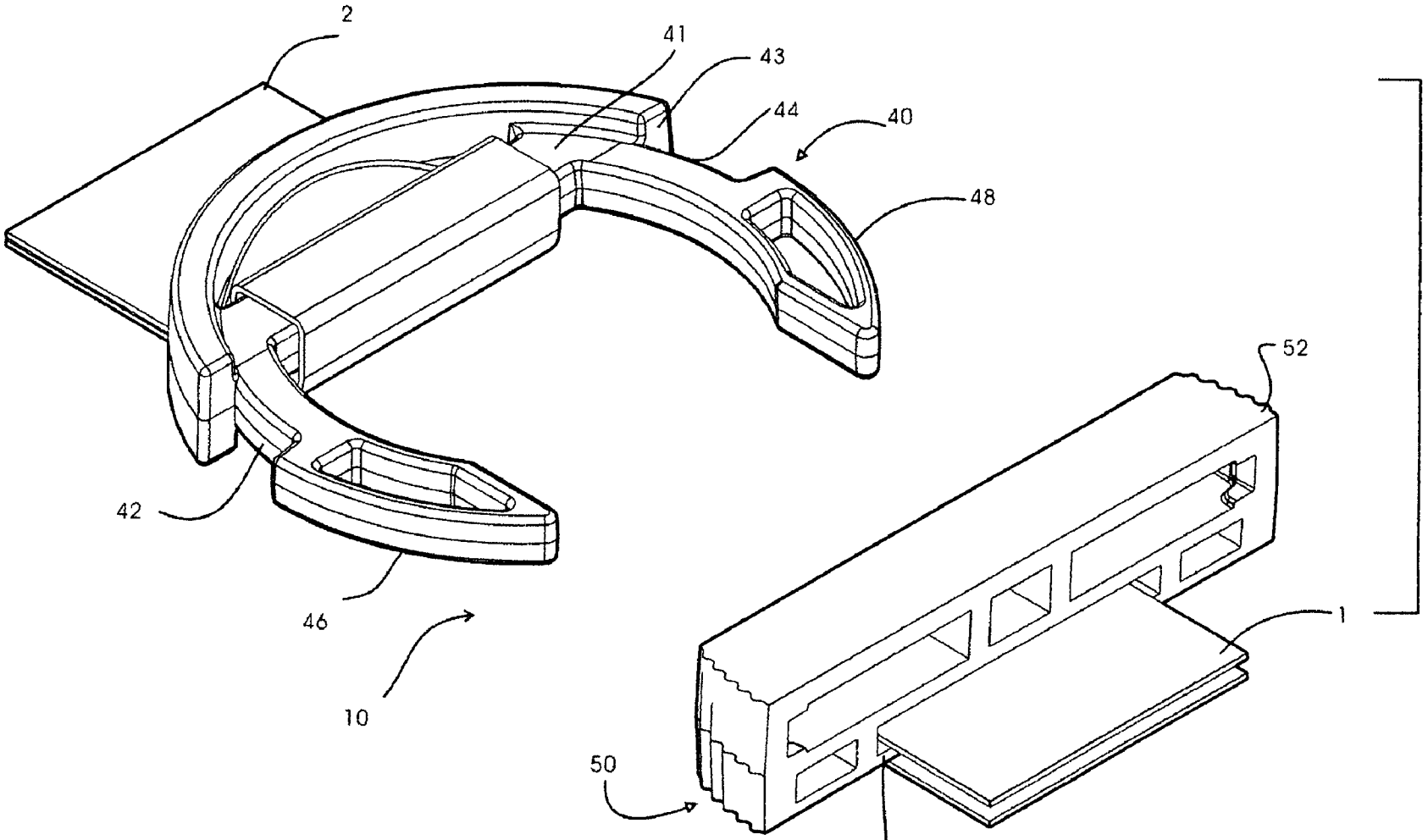
FIG. 1 is a perspective view of a horseshoe buckle in accordance with a preferred embodiment of the invention.
Figure 2:
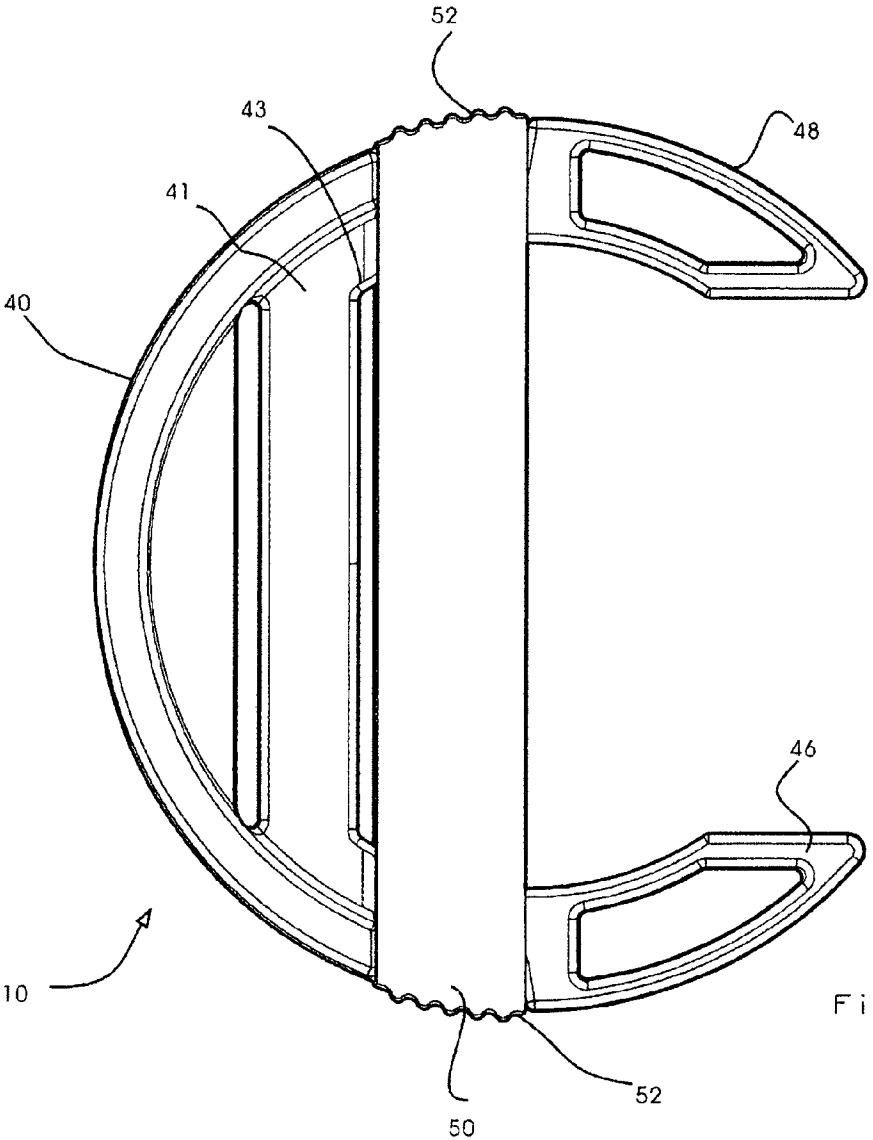
FIG. 2 is top plan view of the horseshoe buckle in accordance with the invention.

Reference is first made to FIGS. 1 and 2 wherein a horseshoe buckle constructed in accordance with a preferred embodiment of the invention is depicted. FIG. 1 shows a perspective view of the horseshoe buckle 10 in its assembled and locked position with straps secured to both the male 40 and female 50 portions of the buckle. As shown, the path by which the straps 1 and 2 are secured to the male and female portions. As can be seen, due to the close proximity of the straps in this closed position, the straps can closely hug a curved section or corner which has not been feasible with prior art buckles. The horseshoe buckle itself is extremely small and lightweight, with female component 50 being potentially only a very narrow band as shown best in FIG. 5.

Figure 3:
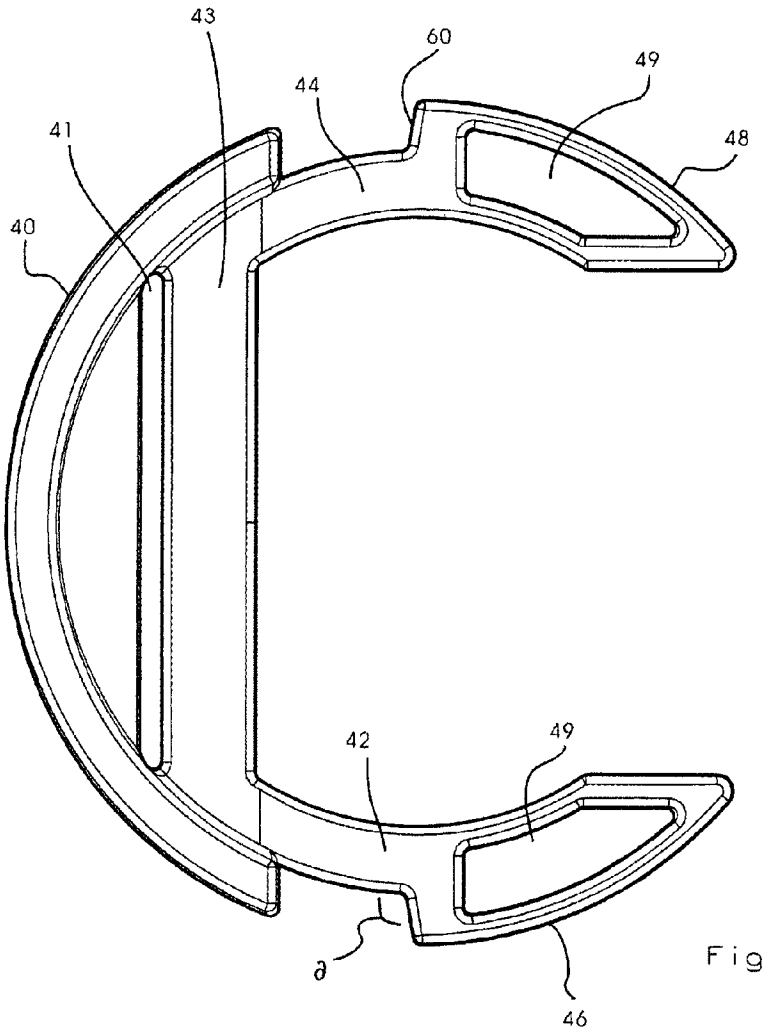
FIG. 3 is a top plan view of the male buckle portion of the horseshoe buckle of FIGS. 1 and 2.
Figure 4:
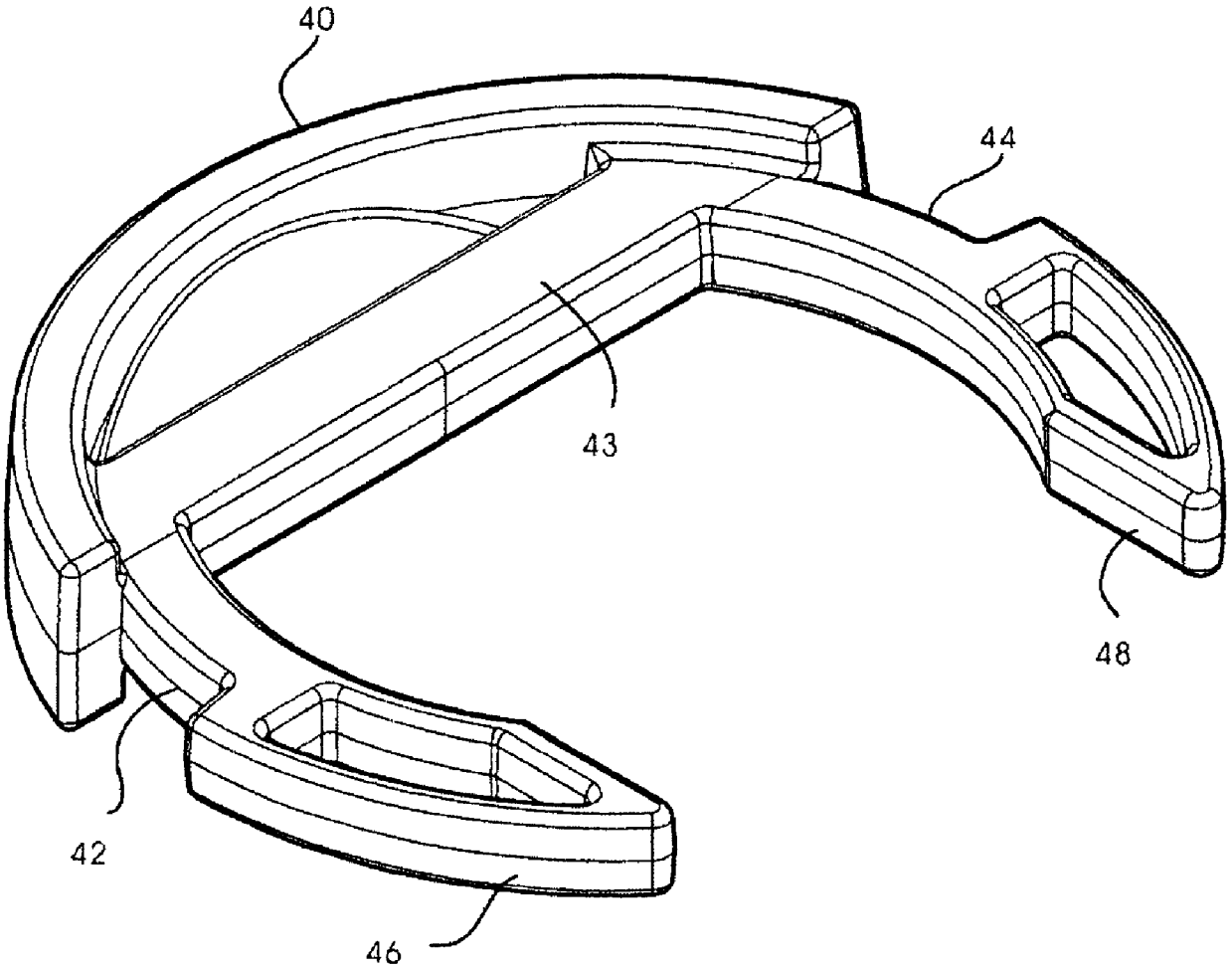
FIG. 4 is a perspective view of the male buckle portion of the horseshoe buckle of FIGS. 1 and 2.

As seen in FIGS. 1 and 2, male buckle portion 40 is adapted to slide within the openings in female buckle member 50. As shown in more detail in FIGS. 3 and 4, male buckle portion 40 contains a male strap receiving means 41 and an engaging means consisting of two prongs 42 and 44. The male strap receiving means 41 and prongs 42 and 44 are connected by an interface section 43. The prongs slide through an opening of the female buckle member and then lock in place on the other side with extending walls 52 preventing casual sliding back in the opposite direction. Two prongs 42 and 44 contain a barb portion 46 and 48. Barb portion 46 and 48 create a barb angle $\alpha$ with prongs 42 and 44. This barb angel $\alpha$ is less than 90 degrees. If this angel is greater than 90 degrees, there is a possibility that the prongs can disengage very easily from the female portion allowing the buckle to release. Release is done by squeezing the two barb sections of the horseshoe and pushing the male section back through the female section. The prongs are sufficiently flexible that they can be easily deformed as they slide in and then as they slide out when pressure is applied to the barbs to free them for disengagement. The material is sufficiently sturdy and rigid in the other directions to maintain the structural integrity of the buckle and prevent unintended release.

Female buckle member includes a receiving volume having an open engagement end 10 and an open locking end 20. A female strap receiving means 53 is positioned on the bottom of the receiving volume, below the horizontal axis of the buckle, such that the first and second strap to be in close proximity. In a preferred embodiment, the female strap receiving means is aligned substantially along open engaging end 10 so that when the male and female buckle members are engaged and locked the female strap receiving means 53 substantially abuts interface section 43 of the male buckle member causing the first and second strap to be in close proximity.

As can be seen in FIGS. 1-6, barb angel $\alpha$ creates and notched section 60. In its locked state, female section 50 sits within notched section 60 of male buckle portion 40 with vertical walls 52 of the female buckle section trapped within the notches on the sides of the male buckle section. In this position the buckle will not open unless the prongs extending beyond the female portion are squeezed together which frees the prongs from the female portion and the male portion is pushed back out of the female section while the prongs are being squeezed.

When two straps are present as shown in FIGS. 1 and 2, a fixed strap is attached to the female portion of the horseshoe buckle and a cinching strap secured is to the male portion of the horseshoe buckle which has a tortuous path. Generally, the fixed strap secured to the female buckle portion would be sewn or otherwise affixed in place on the garment or container to which the strap is affixed and the degree of tightness in the closure system which includes the two sets of straps and the horseshoe buckle including the male and female buckled sections can be adjusted. Generally, the free end of the cinching strap is pulled as in conventional fashion until an appropriate degree of tightness is achieved. Generally, the buckle is secured prior to the final tightening as in conventional buckles.

An important element of the horseshoe buckle design is the manner in which the straps are secured to the male and female buckle sections. Rather than having a traditional coupling at the ends of the buckle such that the buckle itself is a rigid element in the system, the connection system which places the points of contact of the straps with the buckles in close proximity makes the closure system incorporating the buckle particularly capable of adapting to a curved or corner situation.

Figure 6:
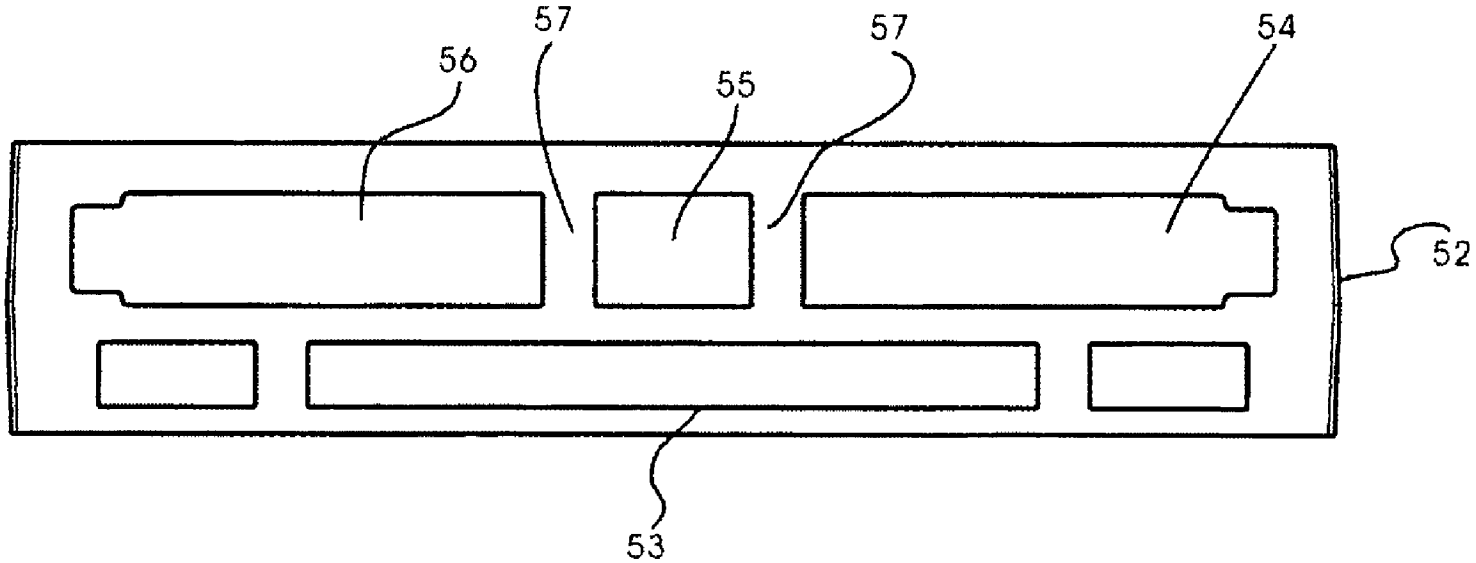
FIG. 6 is a side view of the female buckle portion of the horseshoe buckle of FIGS. 1 and 2.

As shown in FIG. 6, the female section has two axially displaced sets of openings wherein opening 53 is designed to receive the strap. The three sections on the right 54, 55 and 56 are designed to receive and control the movement of the curved prongs at the end of the male buckle section. The top and bottom of those three sections are designed to receive the prongs and walls 57 defining the middle section assure that the prongs do not move together or stray as the buckle is utilized. In addition, these additional walls 57 provide structural rigidity to the buckle itself to assure that it does not open if a twisting force is applied to the buckle.

Figure 7:
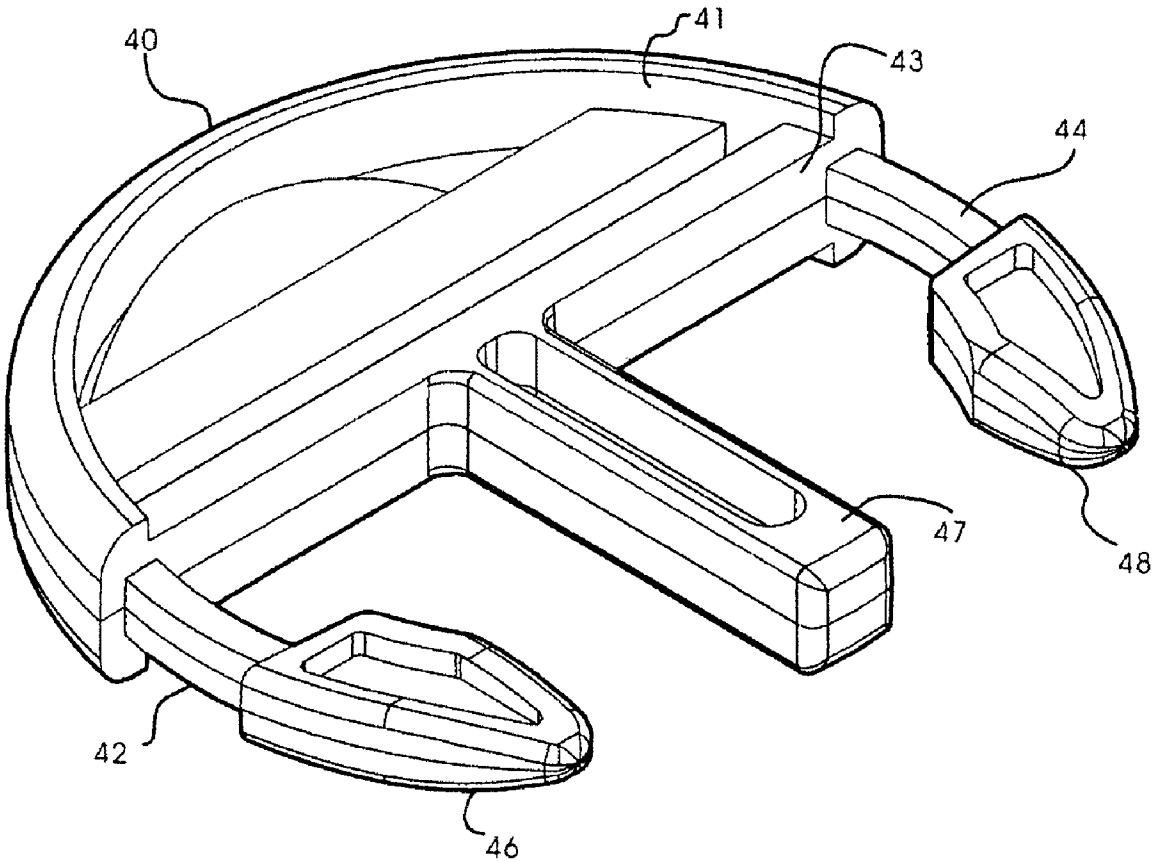
FIG. 7 is a perspective view of another preferred embodiment of the horseshoe buckle according to the invention.
Figure 8:
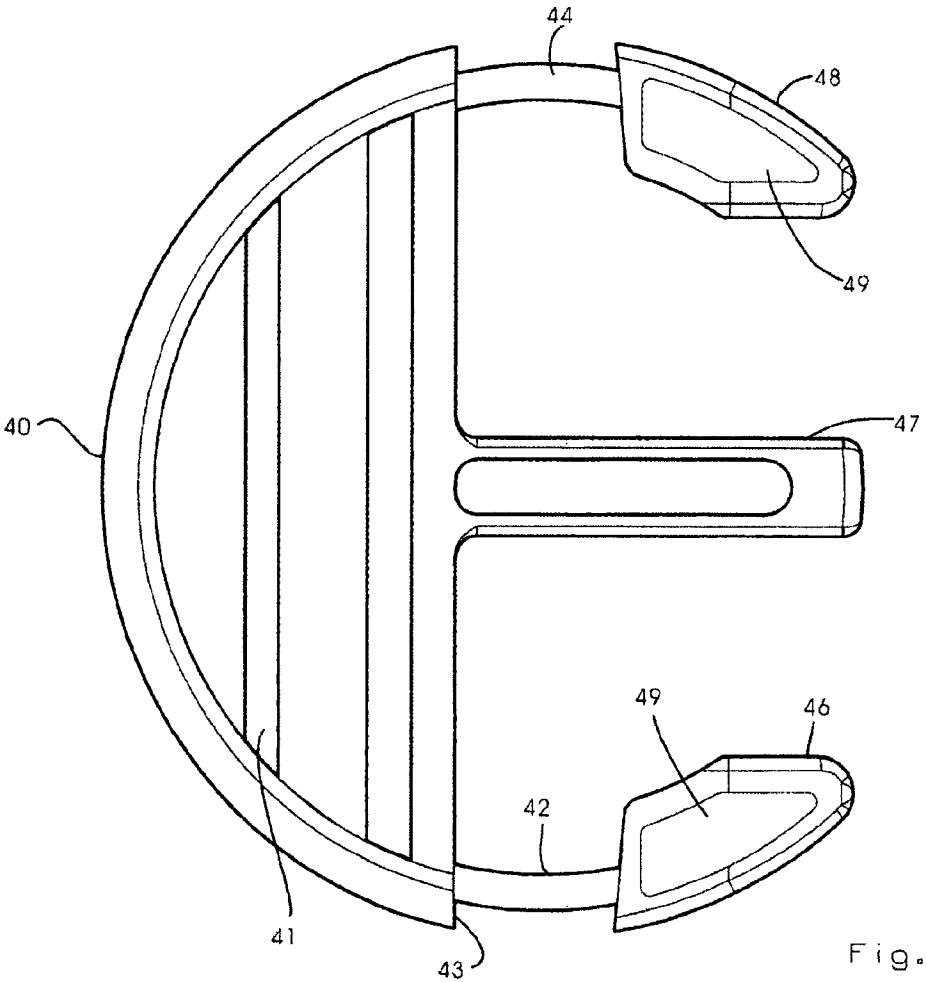
FIG. 8 is a top plan view of the embodiment of FIG. 7.

FIGS. 7 and 8 show another embodiment of the male buckle portion. FIG. 7 shows the addition of a central guide bar 47 to male buckle portion 40. This guide bar provides additional stability and protection against the buckle's releasing due to torsional forces exerted on the buckle by twisting. Further, an additional change is that the barb portions 46 and 48 are not hollowed out portions 49 as shown in each of the other embodiments, which tends to reduce the weight of the buckle, rather it is filled in with a co-molded color 49 which provides a visual indicator for release. Thus, if one sees the secondary color in place, one knows that the buckle is locked.

Figure 9:
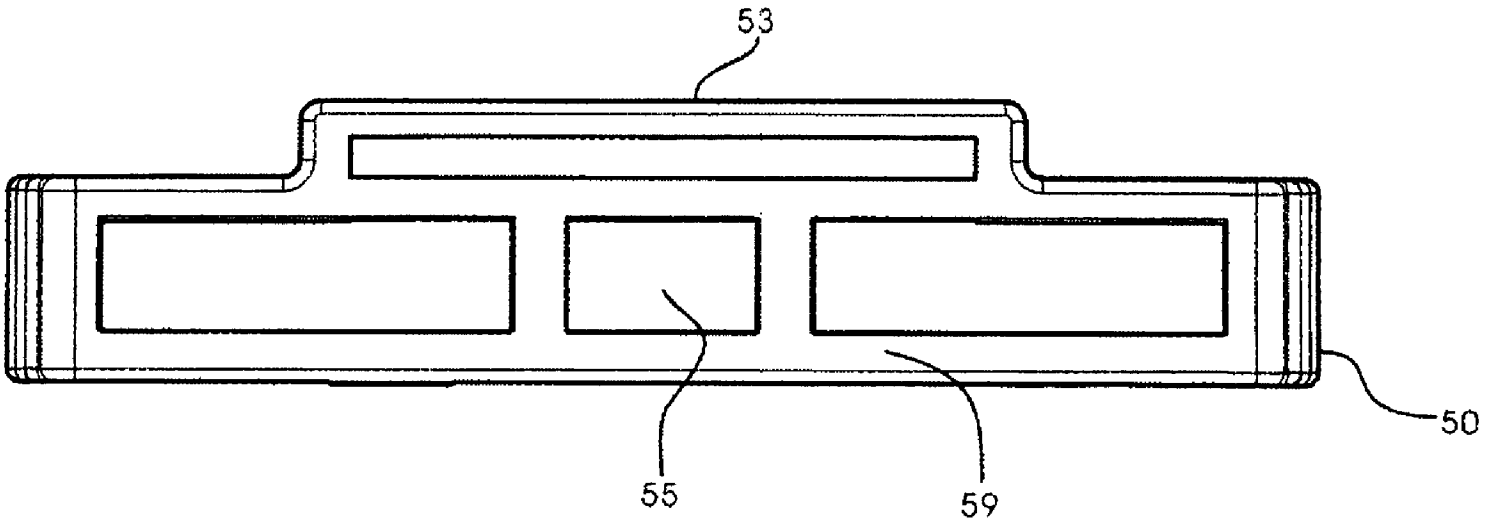
FIG. 9 is a side view of the female buckle portion of the horseshoe buckle of FIG. 7.

FIG. 9 shows female portion 50 having a thinner channel 53 for the strap. The opening is now only a single compartment rather than a full length compartment with two additional side walls to increase the structural rigidity. Also, note that the inner surface of the sections for receiving the male prongs contains a curved portion 59 on one side which tends to keep the prongs more reliably moving where intended and not straying or catching. Opening 55 in the center is designed to receive guide bar 47 of male buckle 40. Guide bar 47 and opening 55 tend to assure that the male portion of the buckle slides smoothly and correctly through the female portion. When seated, the guide bar sits within the parameters of the widened rectangular region in the center of the main opening of the female buckle portion. It also enhances the structural rigidity of the buckle so that a lighter and thinner walled buckle construction can be used without sacrificing the strength of the buckle.

Figure 10A:
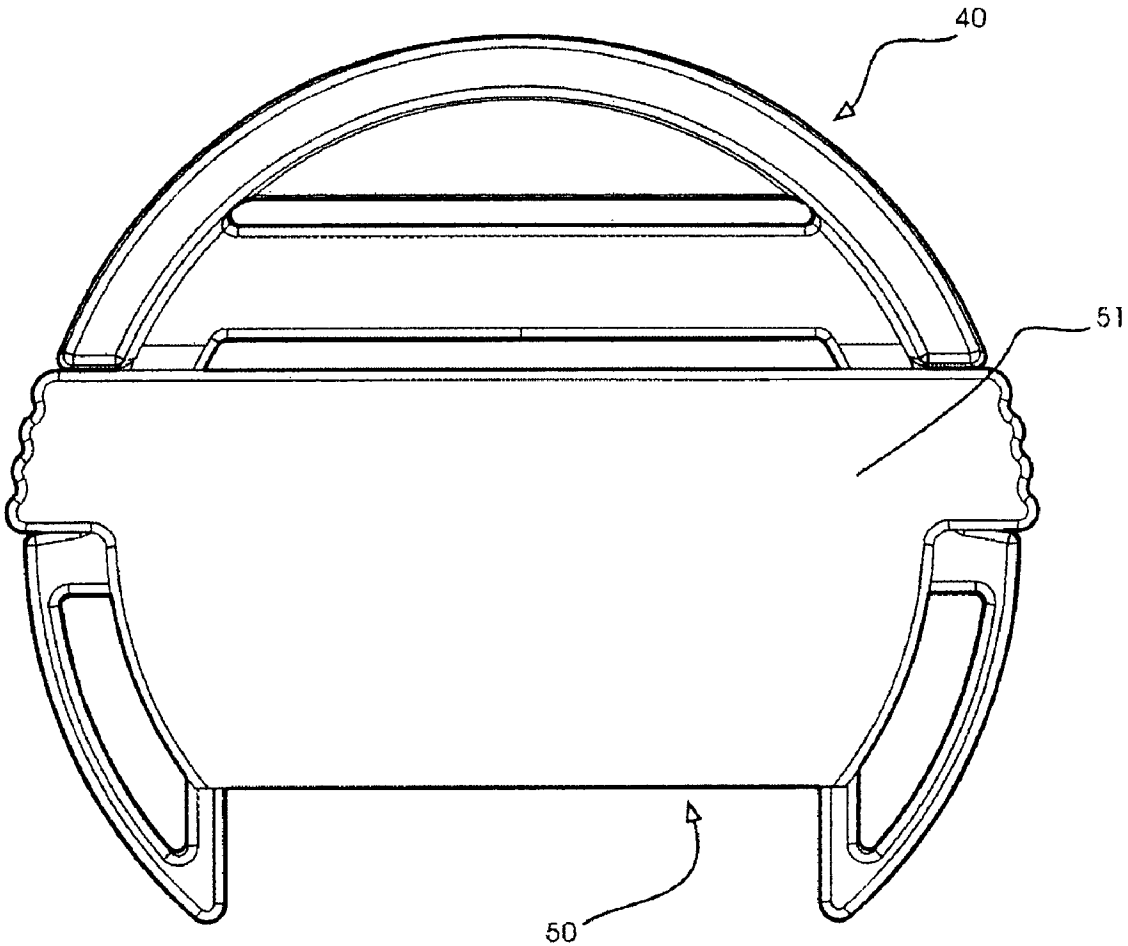
FIGS. 10(*a*) and 10 (*b*) show top plan views of variations of the female buckle portion.
Figure 10B:
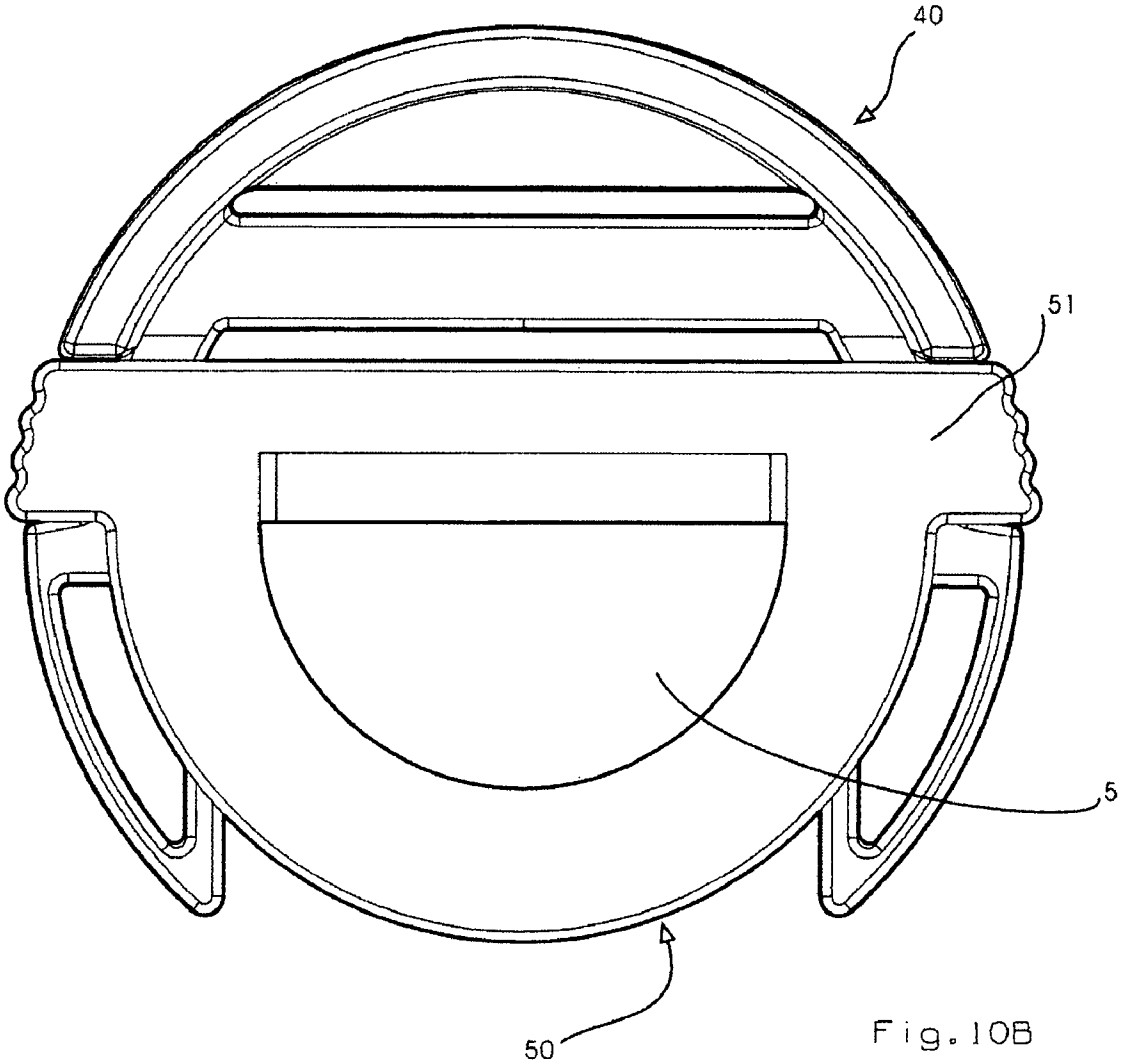
Figure 11:
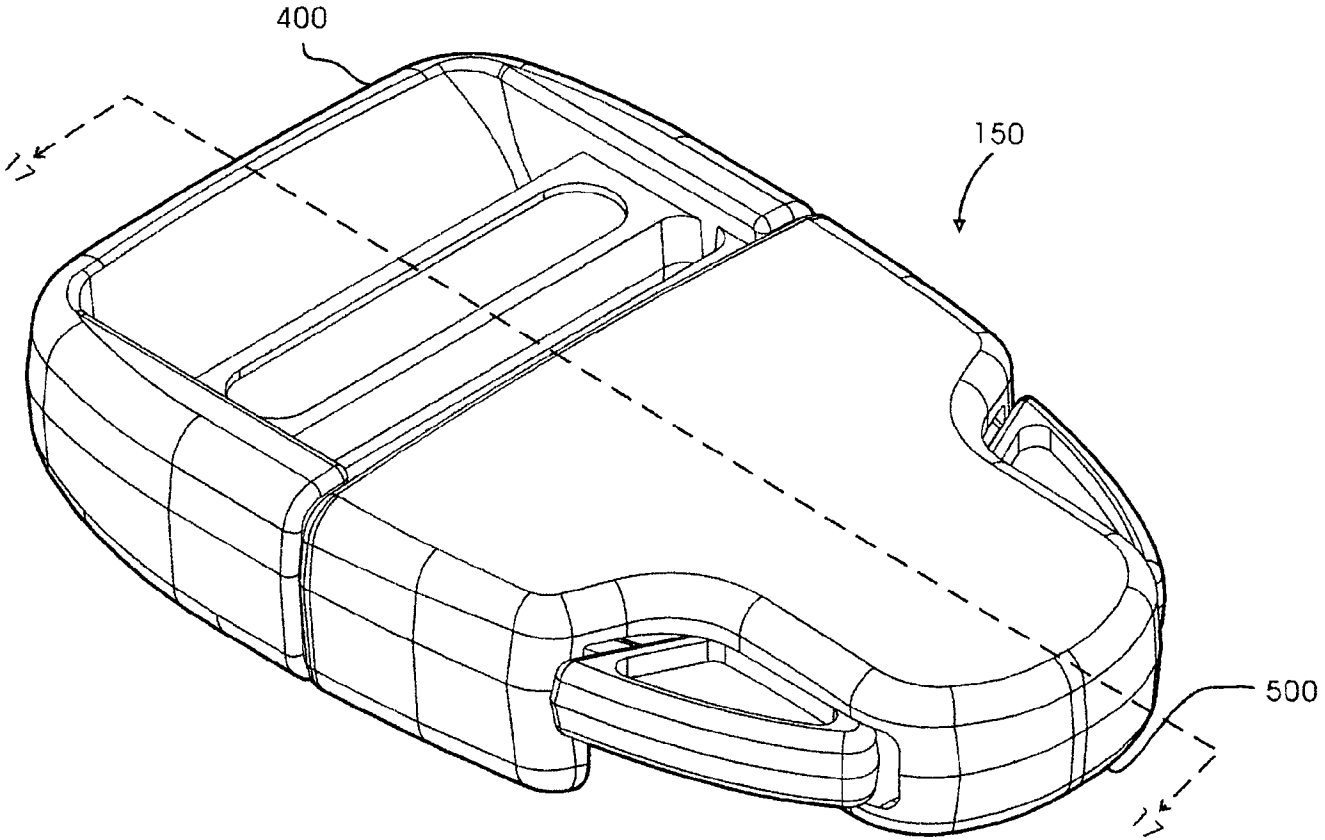
FIG. 11 is a perspective view of a generally rectangular shortened buckle in accordance with a second preferred embodiment of the invention.

Reference is next made to FIGS. 10(*a*) and (*b*) wherein a variety of different cover 51 options for the female buckle portion of the horseshoe buckle in accordance with the invention are depicted. FIG. 10 (*a*) a solid female cover and (*b*) shows a hollow female cover having an opening 5. Rather than a logo, a design or other visual image may be placed on the cover. The cover also provides the functional benefit of preventing stray materials from getting caught in the buckle.

Figure 5:
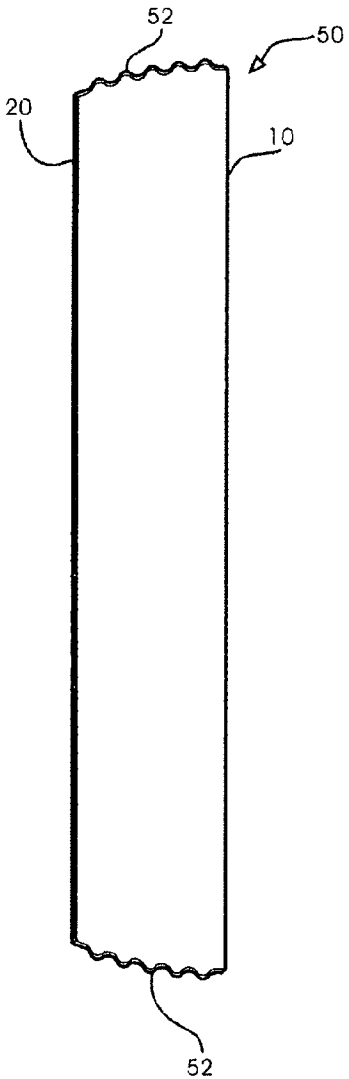
FIG. 5 is a top plan view of the female buckle portion of the horseshoe buckle of FIGS. 1 and 2.

The horseshoe buckle is preferably formed as two injection molded pieces from an appropriate plastic or polymer in accordance with conventional buckle technology. The required strengths and flexibility are achieved by selection of the appropriate materials and wall thicknesses. The horseshoe buckle is particularly superior because it provides the shortest buckle arrangement, with the distance between the points of connection of the two straps in the closed position minimized. In variations of its embodiments it is extremely lightweight, particularly if the bare female portion as shown in FIG. 5 is utilized. The buckle is able to allow the straps to turn corners and hug rounded sections without the fixed rigidity in the area of the buckle running the length of the buckle. In addition, the horseshoe buckle system tends to reduce the bulk in any strap system. The oversized release areas which incorporate the prongs at the end of the horseshoe are easy to manipulate even if wearing gloves or mittens and, similarly, the guide surfaces provided within the various embodiments of the horseshoe buckle allow for easy insertion with limited dexterity. The buckled sections are suitable for use with compression straps and particularly suitable for many short webbing applications where a very short section of strap is to be utilized with enhanced flexibility of the strap. Traditional buckles which have the connection points for the straps separated apart provide stiff sections which affect the flexibility of the system. These considerations are dealt with by the horseshoe buckle quite effectively.

Figure 12:
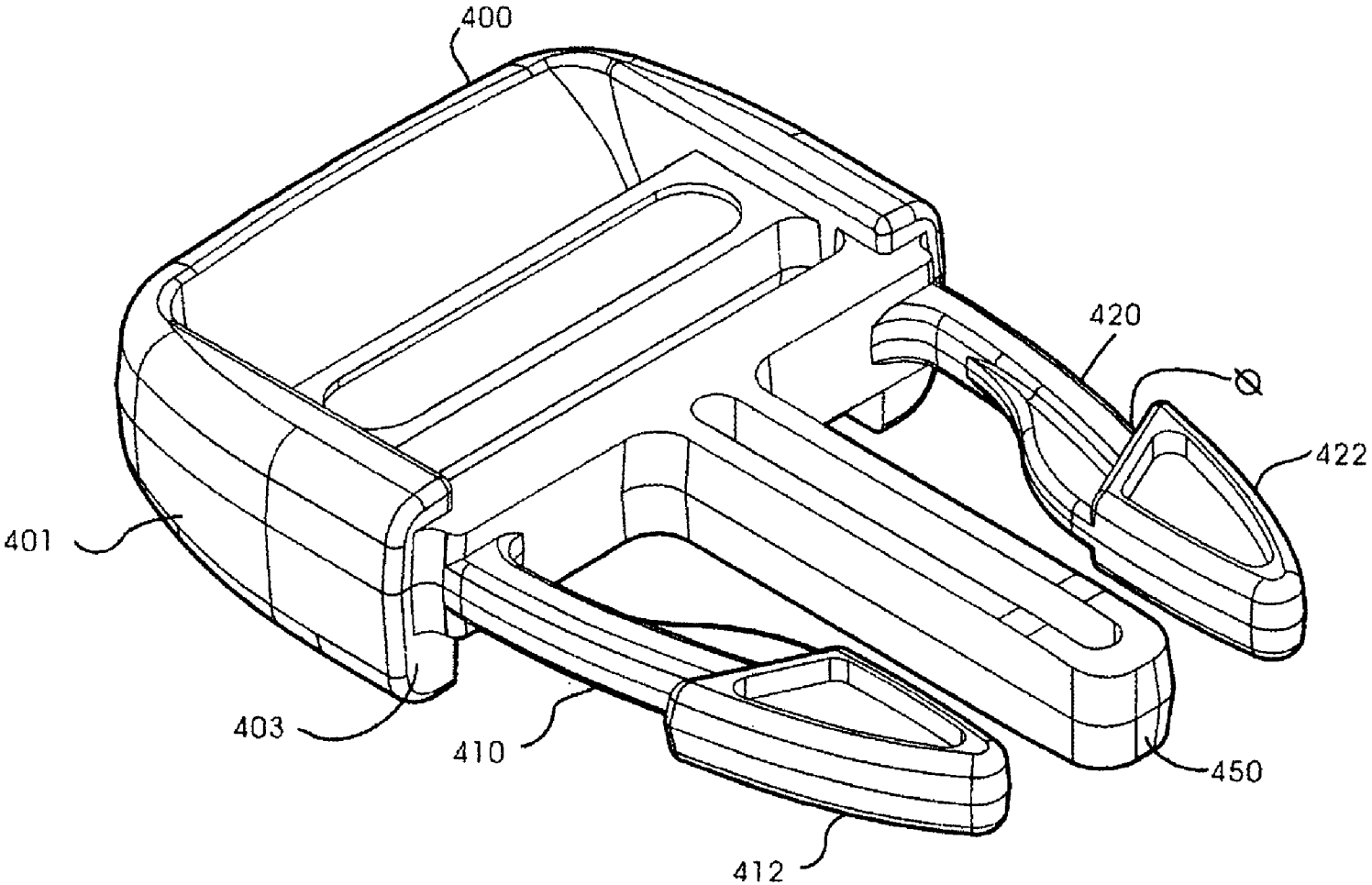
FIG. 12 is a perspective view of the male buckle portion of the embodiment shown in FIG. 11.
Figure 13:
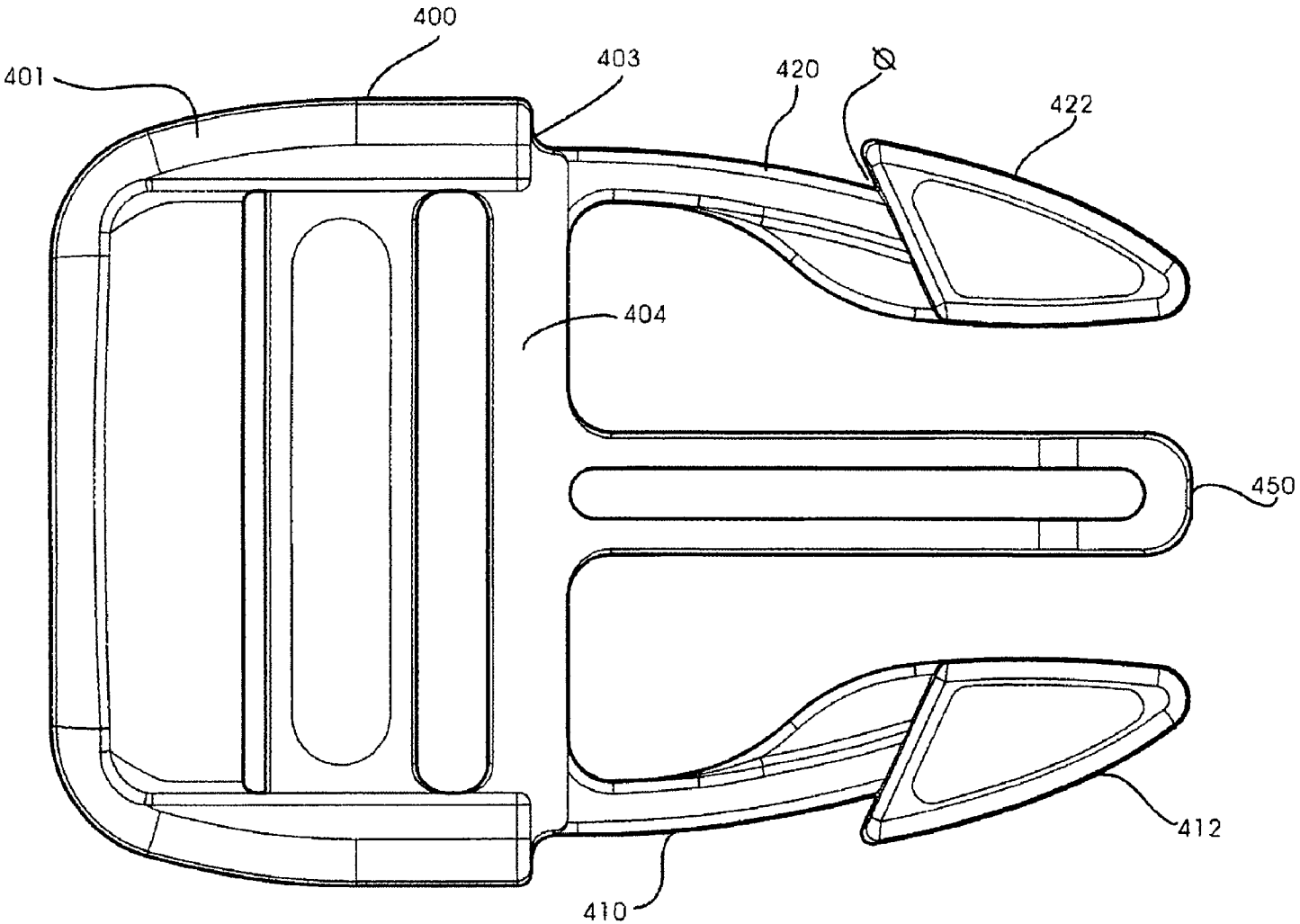
FIG. 13 is a top plan view of the male buckle portion of the embodiment shown in FIG. 11.
Figure 14:
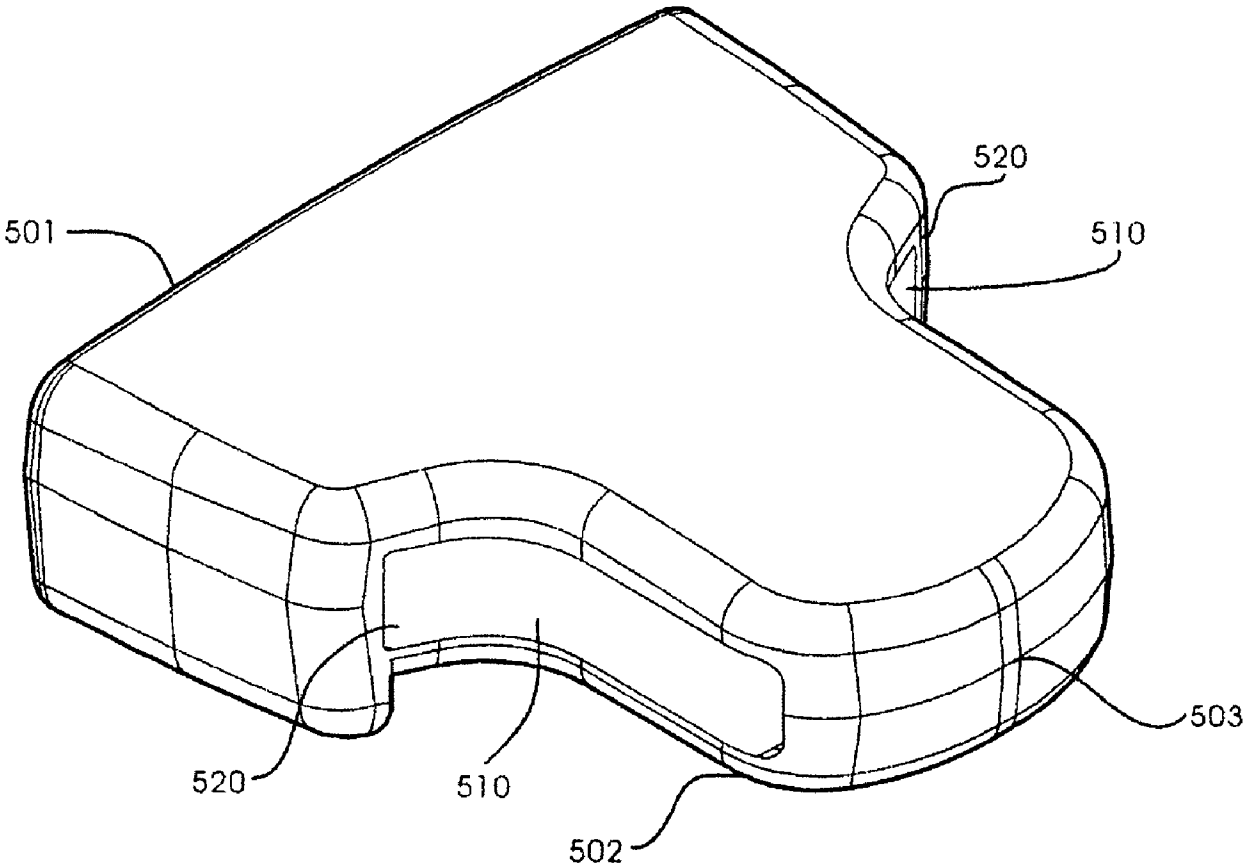
FIG. 14 is a perspective view of the female buckle portion of the embodiment shown in FIG. 11.

Reference is next made to FIGS. 11-18 wherein an alternate embodiment of a shortened buckle system in accordance with a second major preferred embodiment of the invention is depicted. Rather than having the horseshoe shaped orientation, this buckle 150 has a traditional generally rectangular shape with one end narrowed. This embodiment also includes a male buckle portion 400 and a female buckle portion 500. As shown in FIGS. 12-14, male buckle portion 400 has a male strap receiving means 401 and a engaging means of two prongs 410 and 420 with extended barbs 412 and 422 which engage with the hollow openings or channels 510 (shown in FIG. 15) in female buckle section 500. The engaging means connects with male strap receiving means at interface section which includes a cross bar 404 and a shoulder area 403. Barbs 412 and 422 slide through the channel in the female section and rest in the exposed area where the barbs rest against walls 520 of the female portion locking the buckle together. Again, two prongs 410 and 420 create a barb angle θ with the barbs 412 and 422. This barb angel θ is less than 90 degrees. If this angel is greater than 90 degrees, there is a possibility that the prongs can disengage very easily from the female portion allowing the buckle to release. Disengagement of the buckle is achieved by squeezing the prongs of the male section allowing the two pieces to come apart.

Figure 15:
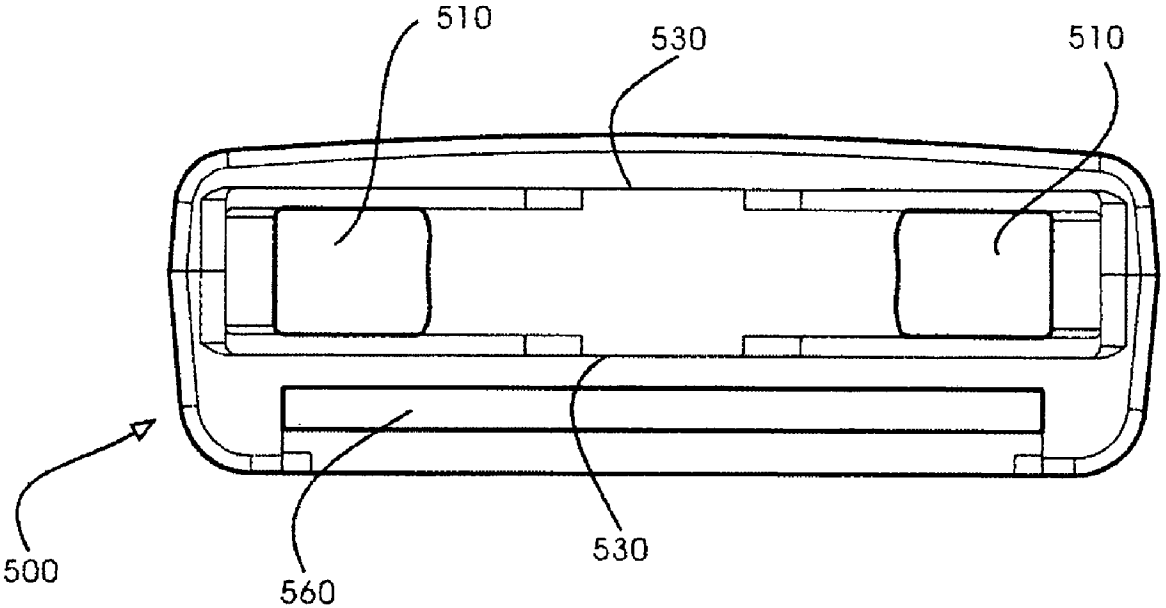
FIG. 15 is an end view of the female buckle portion of the embodiment shown in FIG. 11.

As seen in FIG. 12, male buckle portion 400 contains a central guide member 450 as was included in some of the embodiments of the horseshoe design. This guide member provides enhanced security and protection against unintended release of the buckle due to twisting, as well as providing a guide so that the male and female buckle portions come together smoothly. FIG. 15 is a cross sectional view of the buckle showing a channel 530 along which the central guide bar slides and is secured.

Figure 16:
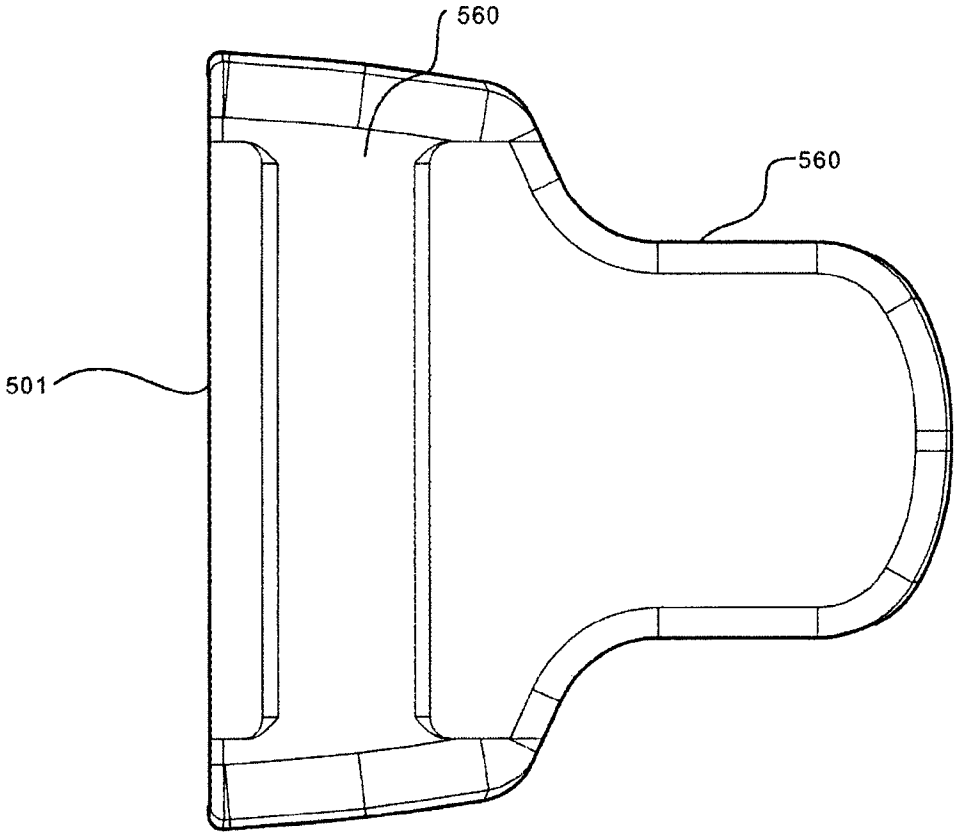
FIG. 16 is a top plan view of a variation of the female buckle portion of the embodiment shown in FIG. 11.

As shown in FIGS. 14-16, the main body of the female portion is hollow with open engaging end 501 and an open locking end 502 with a locking end wall 503 defining openings 510 on the sides to allow the barbs of the male portion to extend outwardly and then lock in place when fully pressed into the female portion. A female strap receiving means 560 is positioned on the bottom of the receiving volume and substantially along open engaging end 501 so that when the male and female buckle members are engaged and locked the female strap receiving means 560 substantially abuts interface section at cross bar 404 and shoulder 403 of the male buckle member causing the first and second strap to be in close proximity.

Figure 17:
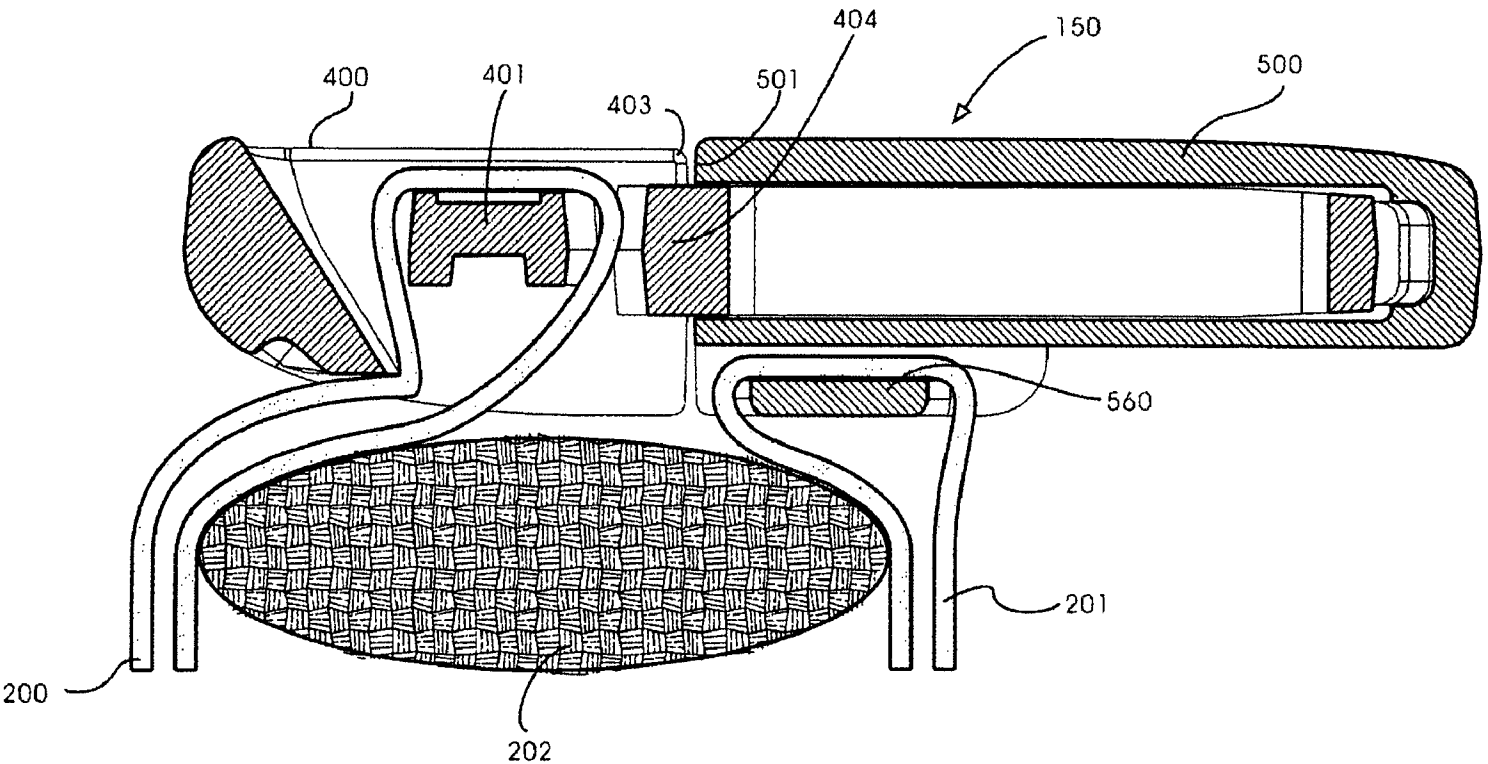
FIG. 17 is a side cross sectional view along the lines 17-17 of the buckle of FIG. 11 with straps attached.

As shown in the cross section view of the locked buckle in FIG. 17, in the generally rectangular construction of the shortened buckle system the same attenuated distance between the points of contact of the straps with the respective buckles is achieved. However, this is achieved with the rectangular shortened buckle system by moving the connection point on the female buckle section off axis from the female portion's connection with the male portion. This is similar to the way it is done with the horseshoe arrangement in which the female portion has essentially two parallel openings, one to receive the male prongs and the other to receive the straps secured to the female portion. This allows the connection point of the straps to be proximate the leading edge of the female buckle portion and, thus, near to the connection point for the strap attached to the male portion of the buckle. FIG. 17 shows the way in which the straps 200 and 201 are secured to the male and female portions. At least one of the straps 200 or 201 are secured to an article 202, such as a jacket or backpack.

Accordingly, two significant new embodiments of a shortened buckle system incorporating a horseshoe design and a generally rectangular design are provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A buckle comprising:

a male horseshoe buckle member including a male strap receiving means for coupling to a first strap and an engaging means for releasably engaging with a female buckle, said engaging means having two prongs each having a barb end portion, said male strap receiving means and said prongs being connected by an interface section, said barb end portion creating a barb angle with said prongs;

a female buckle member including:

a receiving volume having an open engaging end and an open locking end;

interior walls defining channels for receiving said prongs of said male buckle member;

inwardly curved edges at said open locking end for securing engagement with said barb end portion of said male buckle member;

a female strap receiving means for coupling to a second strap, said female strap receiving means being positioned on a bottom of said receiving volume and proximate said open engaging end so that when said male and female buckle members are engaged and locked, said female strap receiving means abuts said interface section of said male buckle member causing said first and second straps to be in close proximity to each other.

2. The buckle as claimed in claim 1, wherein said barb angle is less than 90 degrees.

3. The buckle as claimed in claim 1, further comprising a guide bar extending from said interface section and being disposed laterally between said prongs.

4. The buckle as claimed in claim 1, wherein said female buckle member comprises a channel for receiving said guide bar.

5. The buckle as claimed in claim 1, wherein said female buckle member comprises a cover plate.

6. The buckle as claimed in claim 1, wherein said barb end portion is hollow in structure.

7. The buckle as claimed in claim 1, wherein said barb portion contains a co-molded color which provides a visual indicator for release.

* * * * *